US008213815B2

(12) United States Patent
Matsuoka

(10) Patent No.: US 8,213,815 B2
(45) Date of Patent: Jul. 3, 2012

(54) IMAGE FORMING APPARATUS

(75) Inventor: Emiko Matsuoka, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 357 days.

(21) Appl. No.: 12/556,008

(22) Filed: Sep. 9, 2009

(65) Prior Publication Data

US 2010/0061746 A1 Mar. 11, 2010

Related U.S. Application Data

(60) Provisional application No. 61/095,501, filed on Sep. 9, 2008.

(51) Int. Cl.
*G03G 15/00* (2006.01)

(52) U.S. Cl. ..... 399/45

(58) Field of Classification Search ..... 399/45
See application file for complete search history.

(56) References Cited

U.S. PATENT DOCUMENTS

| | | | | |
|---|---|---|---|---|
| 5,214,470 | A * | 5/1993 | Denber | 355/75 |
| 7,048,272 | B2 * | 5/2006 | Lay et al. | 271/225 |
| 2005/0262394 | A1 * | 11/2005 | Yasukawa et al. | 714/23 |

FOREIGN PATENT DOCUMENTS

| | | |
|---|---|---|
| JP | 09-146420 | 6/1997 |
| JP | 2003-005468 | 1/2003 |
| JP | 2003-209662 | 7/2003 |
| JP | 2006-297706 | 11/2006 |

* cited by examiner

*Primary Examiner* — Constantine Hannaher
(74) *Attorney, Agent, or Firm* — Turocy & Watson, LLP

(57) ABSTRACT

An image forming apparatus includes a sheet conveying path that conveys a sheet from a paper feeding tray to a secondary transfer position, an image transfer unit that transfers an image onto the sheet conveyed to the secondary transfer position via the sheet conveying path, a detection sensor that optically acquires information concerning a dirty spot on the sheet in a detection position located further on an upstream side than the secondary transfer position in the sheet conveying path, and a CPU that determines, on the basis of the information acquired by the detection sensor, whether a dirty spot is present in a predetermined region of the sheet.

9 Claims, 10 Drawing Sheets

IMAGE FORMING APPARATUS

CROSS-REFERENCE TO RELATED APPLICATION

This application is based upon and claims the benefit of priority from: U.S. provisional application 61/095,501, filed on Sep. 9, 2008; the entire contents of each of which are incorporated herein by reference.

TECHNICAL FIELD

This specification relates to an image forming apparatus that enables effective utilization of a sheet.

BACKGROUND

In the past, from the viewpoint of realizing effective utilization of resources, there is proposed an image forming apparatus that directly reuses, as a print sheet, a sheet that passes through the image forming apparatus. In this related art, it discloses an image forming apparatus that controls processing for reusing a sheet that passes through the image forming apparatus. The image forming apparatus detects, with a sensor, dirty spots on both the sides of a sheet to be reused, which is fed from a paper feeding cassette. When a dirty spot is detected only on one side of the sheet, the image forming apparatus forms, with effective image forming means, an image only on the other side on which a dirty spot is not detected. When no dirty spot is detected on both the sides of the sheet, the image forming apparatus accumulates the sheet in a reverse side paper tray without performing image forming processing. When dirty spots are detected on both the sides of the sheet, the image forming apparatus discards the sheet in a waste tray.

However, in the above related art, since image formation is not performed on the side on which the dirty spot is detected, it is difficult to say that the sheet is sufficiently reused. For example, even when a region including the dirty spot in the sheet and a transfer region in the sheet to which a developer image is transferred do not overlap each other, the sheet is discarded. Therefore, the sheet cannot be effectively utilized. The present invention has been devised to solve the problem and it is an object of the present invention to provide an image forming apparatus that enables effective utilization of a sheet.

SUMMARY

In order to solve the problem, this specification relates to an image forming apparatus including: a sheet conveying path configured to convey a sheet from a paper feeding tray to a transfer position; an image transfer unit configured to transfer an image onto the sheet conveyed to the transfer position via the sheet conveying path; a dirty-spot-information acquiring unit configured to optically acquire information concerning a dirty spot on the sheet in a detection position located further on an upstream side in a conveying direction than the transfer position in the sheet conveying path; and a determining unit configured to determine, on the basis of the information acquired by the dirty-spot-information acquiring unit, whether a dirty spot is present in a predetermine region of the sheet.

This specification relates to an image forming apparatus including: an image-data acquiring unit configured to acquire image data by optically reading an original document; a sheet conveying path configured to convey a sheet from a paper feeding tray to a transfer position; an image transfer unit configured to transfer an image onto the sheet conveyed to the transfer position via the sheet conveying path; a dirty-spot-information acquiring unit configured to optically acquire information concerning a dirty spot on the sheet in a detection position located further on an upstream side in a conveying direction than the transfer position in the sheet conveying path; and a determining unit configured to determine, on the basis of the information acquired by the dirty-spot-information acquiring unit and the image data acquired by the image-data acquiring unit, whether a dirty spot is present in the inside of a transfer region to which the image data is transferred in the sheet.

This specification relates to an image forming apparatus including: a sheet conveying path configured to convey a sheet between a paper feeding tray and a transfer position; an image transfer unit configured to transfer an image onto the sheet conveyed to the transfer position via the sheet conveying path; a density-information acquiring unit configured to optically acquire information concerning the density of the sheet in a detection position located further on an upstream side in a conveying direction than the transfer position in the sheet conveying path; and a determining unit configured to determine, on the basis of the information acquired by the density-information acquiring unit, whether the density of the sheet exceeds a predetermined value.

This specification relates to a sheet determining method in an image forming apparatus including a sheet conveying path configured to convey a sheet from a paper feeding tray to a transfer position and an image transfer unit configured to transfer an image onto the sheet conveyed to the transfer position via the sheet conveying path, the sheet determining method including: optically acquiring information concerning a dirty spot on the sheet in a detection position located further on an upstream side in a conveying direction than the transfer position in the sheet conveying path; and determining, on the basis of the acquired information, whether a dirty spot is present in a predetermined region of the sheet. The image forming apparatus can be configured to change the predetermined region on the basis of operation input of a user. The image forming apparatus can further include a discharge tray configured to discharge the sheet onto which the image is transferred in the transfer position. The image forming apparatus can be configured to discharge the sheet to a position different from the discharge tray when it is determined that a dirty spot is present in the predetermined region of the sheet.

This specification relates to a sheet determining method in an image forming apparatus including an image-data acquiring unit configured to acquire image data by optically reading an original document, a sheet conveying path configured to convey a sheet from a paper feeding tray to a transfer position, and an image transfer unit configured to transfer an image onto the sheet conveyed to the transfer position via the sheet conveying path, the sheet determining method including: optically acquiring information concerning a dirty spot on the sheet in a detection position located further on an upstream side in a conveying direction than the transfer position in the sheet conveying path; and determining, on the basis of the acquired information concerning the dirty spot on the sheet and the acquired image data, whether a dirty spot is present in the inside of a transfer region to which the image data is transferred in the sheet.

DETAILED DESCRIPTION

Embodiments of the present invention are explained below with reference to the accompanying drawings.

First Embodiment

Figure 1:
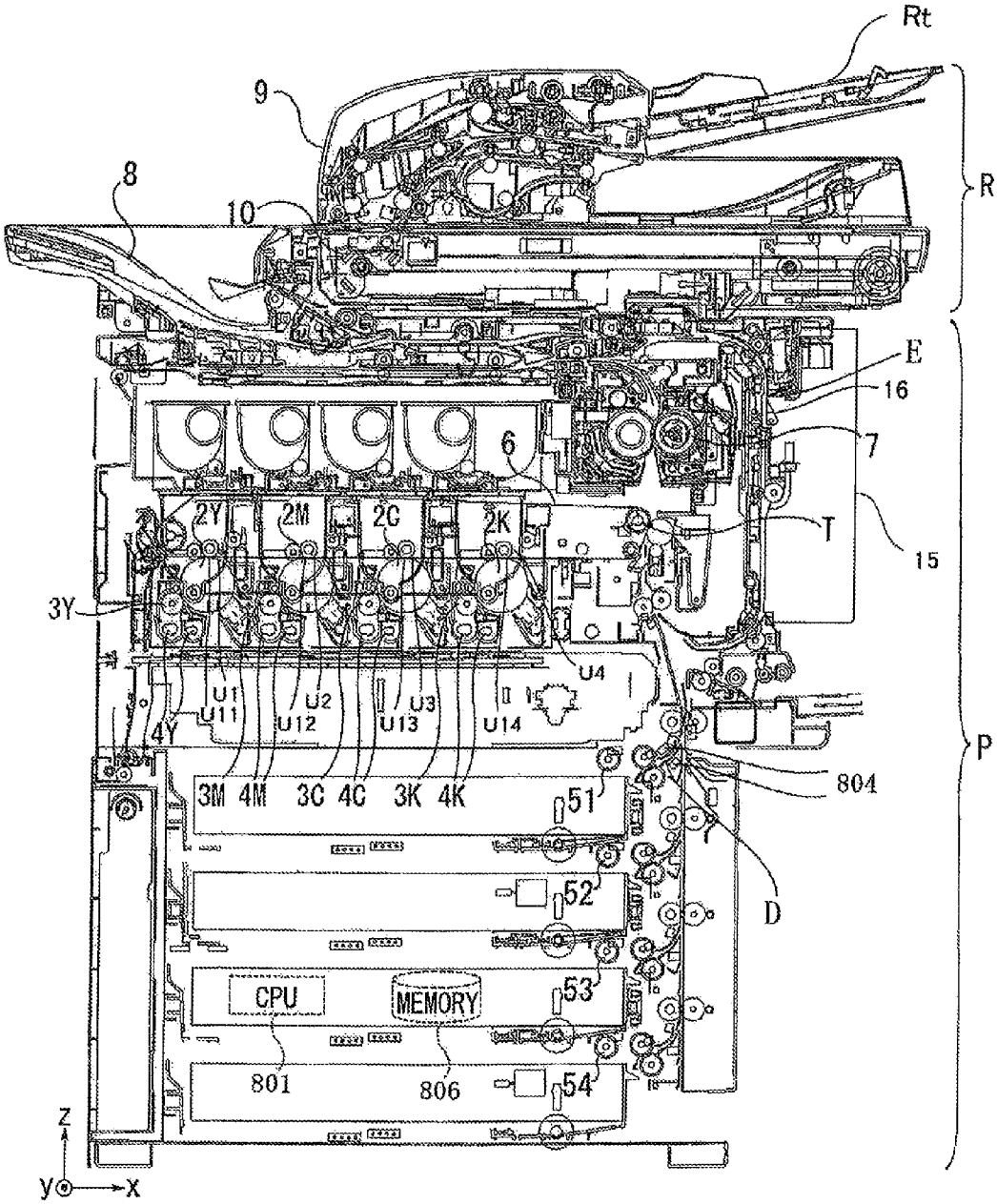
FIG. 1 is a sectional view of an image forming apparatus according to a first embodiment of the present invention in a state during transfer for transferring an image onto a sheet.
Figure 2:
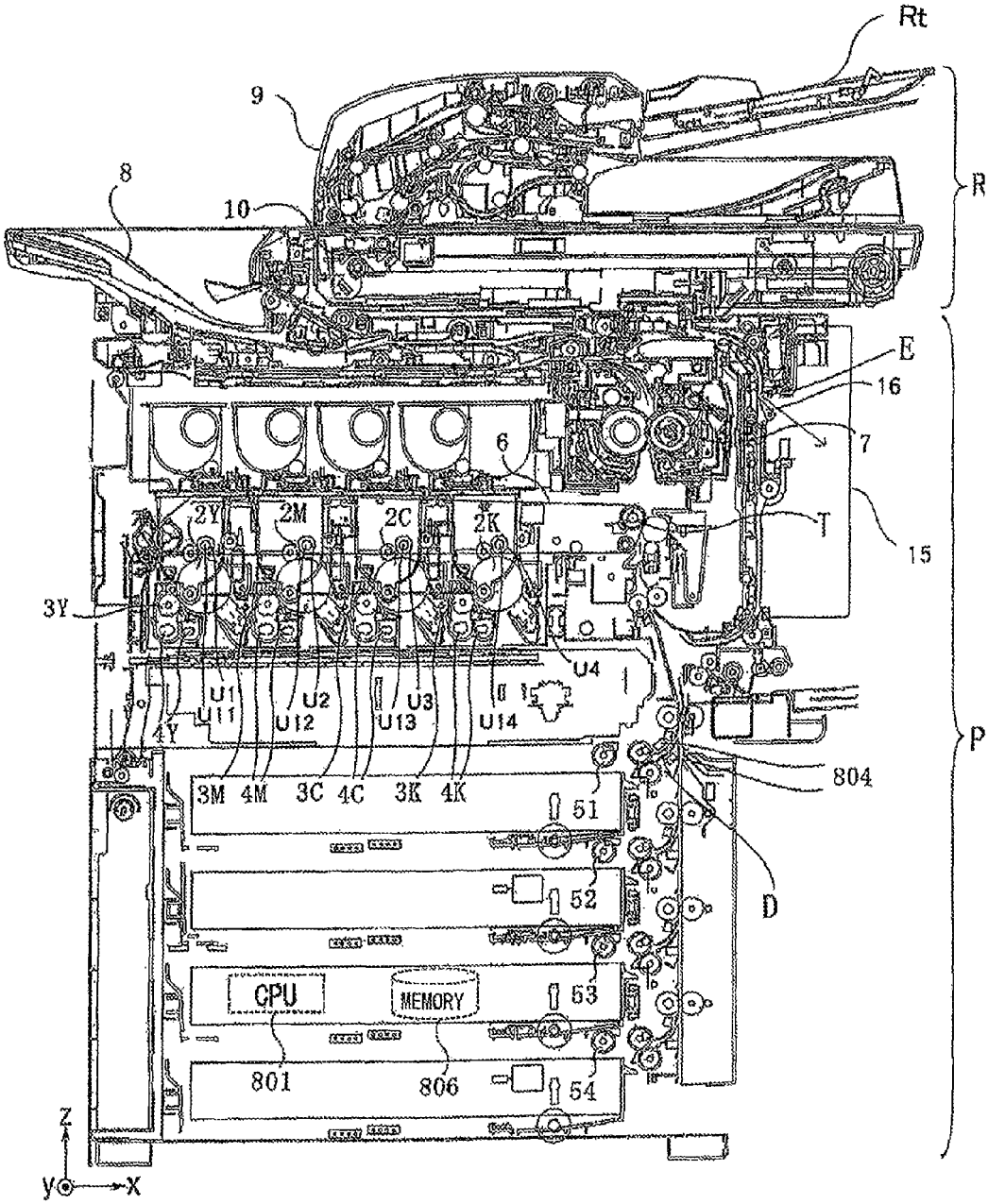
FIG. 2 is a sectional view of the image forming apparatus in a state during transfer prohibition for prohibiting the transfer of the image onto the sheet.

FIGS. 1 and 2 are longitudinal sectional views of a schematic configuration of an image forming apparatus (MFP: Multi Function Peripheral) according to a first embodiment of the present invention. A state during transfer for transferring an image onto a sheet is shown in FIG. 1. A state during transfer prohibition for prohibiting the transfer of the image onto the sheet is shown in FIG. 2. As shown in FIG. 1, the image forming apparatus according to this embodiment includes an image reading unit R and an image forming unit P. The image reading unit R has a function of scanning and reading images of a sheet original document and a book original document. The image forming unit P has a function of forming a developer image on a sheet on the basis of an image read from an original document by the image reading unit R, image data transmitted from an external apparatus to the image forming apparatus, and the like.

The image reading unit R includes an auto document feeder (ADF) 9 that can automatically convey an original document to a predetermined image reading position. The image reading unit R reads, with a scanning optical system 10, images of a sheet original document automatically conveyed by the auto document feeder 9 and placed on a document tray (a predetermined document placing table) Rt and an original document placed on a not-shown document table.

The image forming unit P includes pickup rollers 51 to 54, photoconductive members 2Y to 2K, developing rollers 3Y to 3K, mixers 4Y to 4K, an intermediate transfer belt 6, a fixing device 7, and a discharge tray 8. Tension rollers U1 to U4 are set in contact with an inner surface of the intermediate transfer belt 6.

The image forming apparatus according to this embodiment includes a CPU (a determining unit) 801 and a memory 806. The CPU 801 has a role of performing various kinds of processing in the image forming apparatus and a role of realizing various functions by executing computer programs stored in the memory 806. The memory 806 can include, for example, a RAM (Random Access Memory), a ROM (Read Only Memory), a DRAM (Dynamic Random Access Memory), an SRAM (Static Random Access Memory), or a VRAM (Video RAM). The memory 806 has a role of storing various kinds of information and computer programs used in the image forming apparatus.

An overview of copy processing is explained as an example of processing in the image forming apparatus according to this embodiment. First, sheets picked up from cassettes by the pickup rollers 51 to 54 enter a sheet conveying path. The sheets that enter the sheet conveying path are conveyed in a predetermined conveying direction by plural roller pairs.

The scanning optical system 10 reads, in a predetermined image reading position, images of plural sheet original documents continuously automatically conveyed by the auto document feeder 9. On the basis of image data of the images read from the original documents in the image reading unit R, electrostatic latent images are formed on photoconductive surfaces of the photoconductive members 2Y, 2M, 2C, and 2K for transferring developer images of yellow (Y), magenta (M), cyan (C), and black (K) onto a sheet.

Subsequently, developers agitated by the mixers 4Y to 4K (equivalent to agitating units) in a developing device are supplied to the photoconductive members 2Y to 2K, on which the electrostatic latent images are formed as explained above, by the developing rollers (so-called mag-rollers) 3Y to 3K. Consequently, the electrostatic latent images formed on the photoconductive surfaces of the photoconductive members are visualized.

Developer images formed on the photoconductive members 2Y to 2K in this way are transferred onto a belt surface of the intermediate transfer belt 6 (so-called primary transfer). The developer images conveyed by the rotation of the intermediate transfer belt 6 are transferred onto the conveyed sheets in a predetermined secondary transfer position T.

The developer images transferred onto the sheets are heated and fixed on the sheets by the fixing device 7. The sheets having the developer images heated and fixed thereon are conveyed downstream in the conveying direction in the sheet conveying path by plural conveying roller pairs and sequentially reaches the discharge tray 8.

Figure 3:
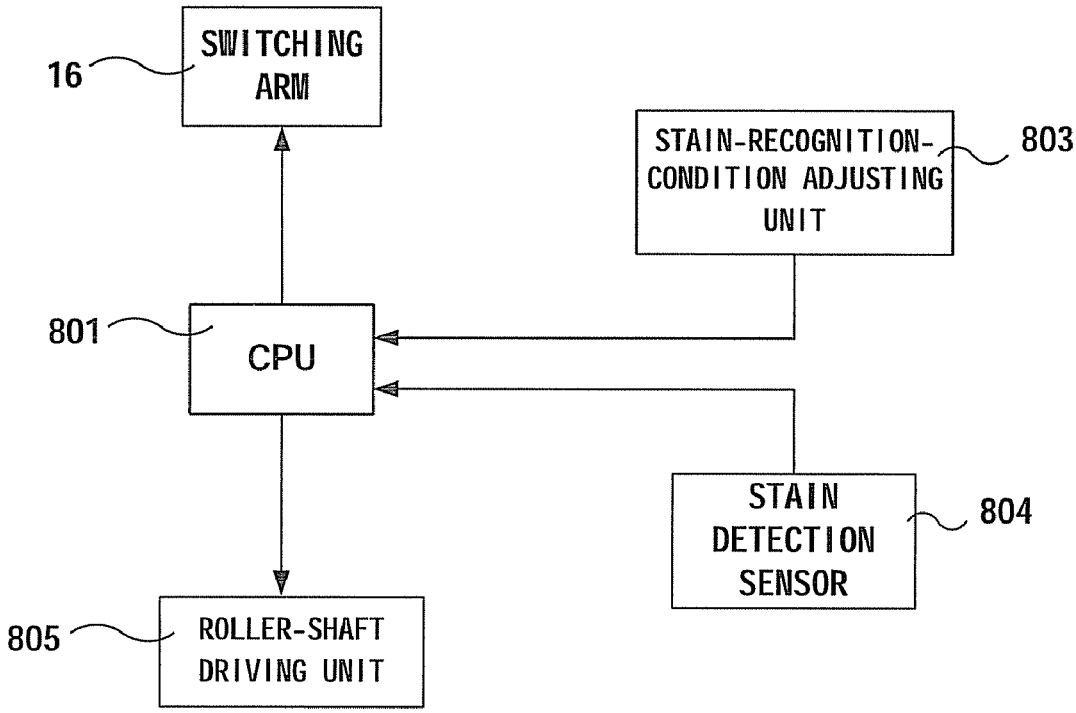
FIG. 3 is a functional block diagram of the image forming apparatus related to dirty spot detection for a sheet according to the first embodiment.

A configuration of the image forming apparatus related to dirty spot detection for a sheet is explained in detail with reference to FIGS. 1 to 3. FIG. 3 is a functional block diagram of the image forming apparatus related to dirty spot detection for a sheet.

A shaft section U11 of the tension roller U1 moves between a pressing position where the intermediate transfer belt 6 is pressed against the photoconductive member 2Y and a separating position where the intermediate transfer belt 6 separates from the photoconductive member 2Y. In the pressing position, since the intermediate transfer belt 6 and the photoconductive member 2Y are in contact with each other, the developer image formed on the photoconductive member 2Y is transferred onto the belt surface of the intermediate transfer belt 6. In the separating position, the contact of the intermediate transfer belt 6 and the photoconductive member 2Y is cutoff. Therefore, the developer image formed on the photoconductive member 2Y is not transferred onto the intermediate transfer belt 6. A shaft section U12 of the tension roller U2 moves between a pressing position where the intermediate transfer belt 6 is pressed against the photoconductive member 2M and a separating position where the intermediate transfer belt 6 separates from the photoconductive member 2M. A shaft section U13 of the tension roller U3 moves between a pressing position where the intermediate transfer belt 6 is pressed against the photoconductive member 2C and a separating position where the intermediate transfer belt 6 separates from the photoconductive member 2C. A shaft section U14 of the tension roller U4 moves between a pressing position where the intermediate transfer belt 6 is pressed against the photoconductive member 2K and a separating position where the intermediate transfer belt 6 separates from the photoconductive member 2K.

The image forming apparatus has a switchback function for switching back a sheet, which passes through the fixing device 7, and conveying the sheet in an opposite direction. The sheet conveyed in the opposite direction by the switchback function moves to a switching position E. A switching arm 16 is provided in the switching position E. The switching arm 16 swings between a transfer allowing position where conveyance of the sheet, which reaches the switching position E, to the secondary transfer position T is allowed and a paper discharge position where conveyance of the sheet, which reaches the switching position E, to a paper discharge box 15 is allowed. A state in which the switching arm 16 is set in the transfer allowing position is shown in FIG. 1. A state in which the switching arm 16 is set in the paper discharge position is shown in FIG. 2.

Detection sensors (dirty-spot-information acquiring units) 804 optically detect dirty spots on the sheets picked up from the cassettes by the pickup rollers 51 to 54. The detection sensors 804 detect dirty spots on the sheets in a dirty spot detection position D further on an upstream side in the conveying direction than the secondary transfer position T. The detection sensors 804 include light emitting elements and light receiving elements. The detection sensors 804 can detect presence or absence of dirty spots by receiving, with the light receiving elements, reflected light of light irradiated on the sheets from the light emitting elements and calculating reflectance. For example, the detection sensors 804 can determine that dirty spots are present when a region indicating reflectance different from that of a white color is equal to or larger than a predetermined area. The detection sensors 804 are located on both the sides across the sheet conveying path. One detection sensor 804 performs dirty spot detection on a front surface of a sheet and the other detector sensor 804 performs dirty spot detection on a rear surface of the sheet.

Sheets having dirty spots include a so-called reverse side paper, one side of which is printed and the other side of which is not printed. Besides the reverse side paper, the sheets include a sheet, to a part of which a toner or an ink adheres because of some reason.

Figure 4:
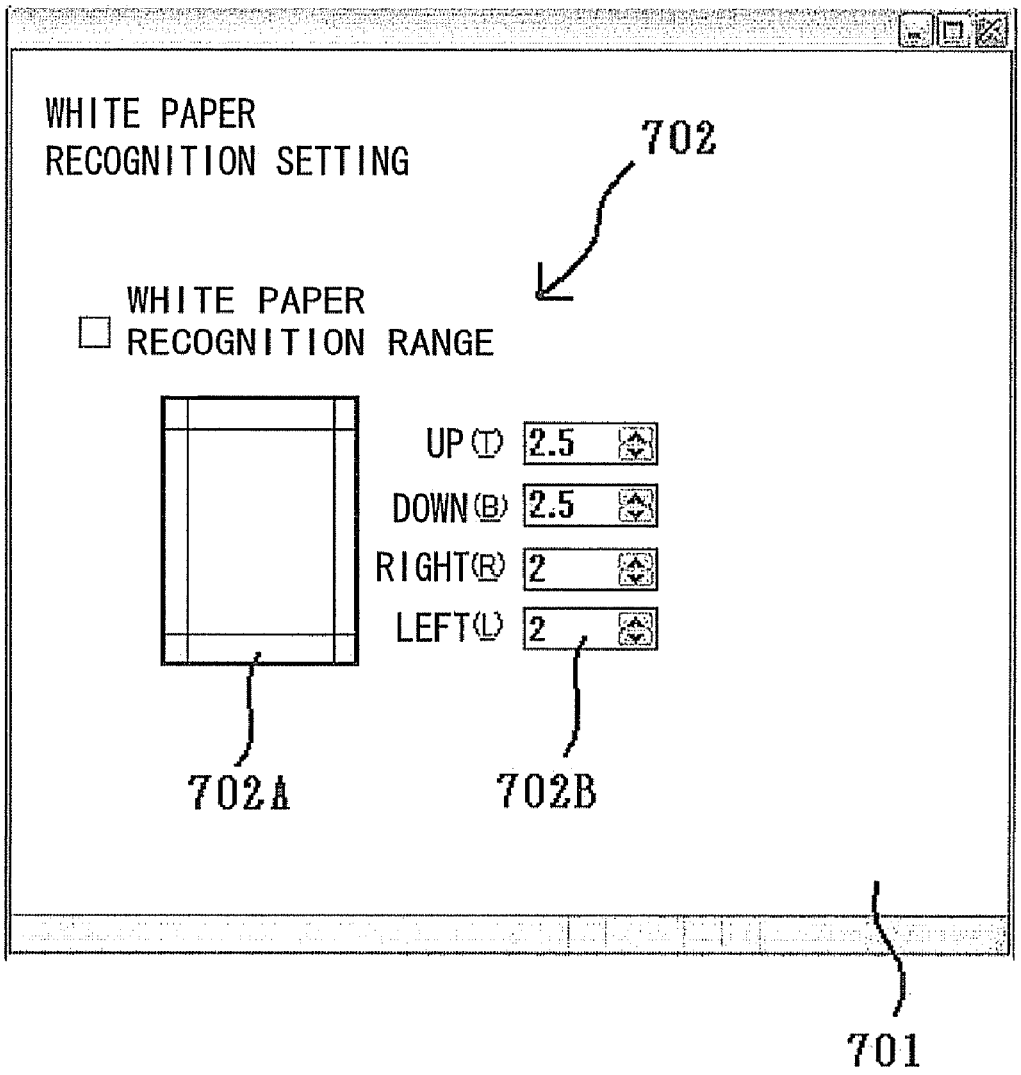
FIG. 4 is a schematic diagram of an adjustment screen displayed on a touch panel display according to the first embodiment.
Figure 5:
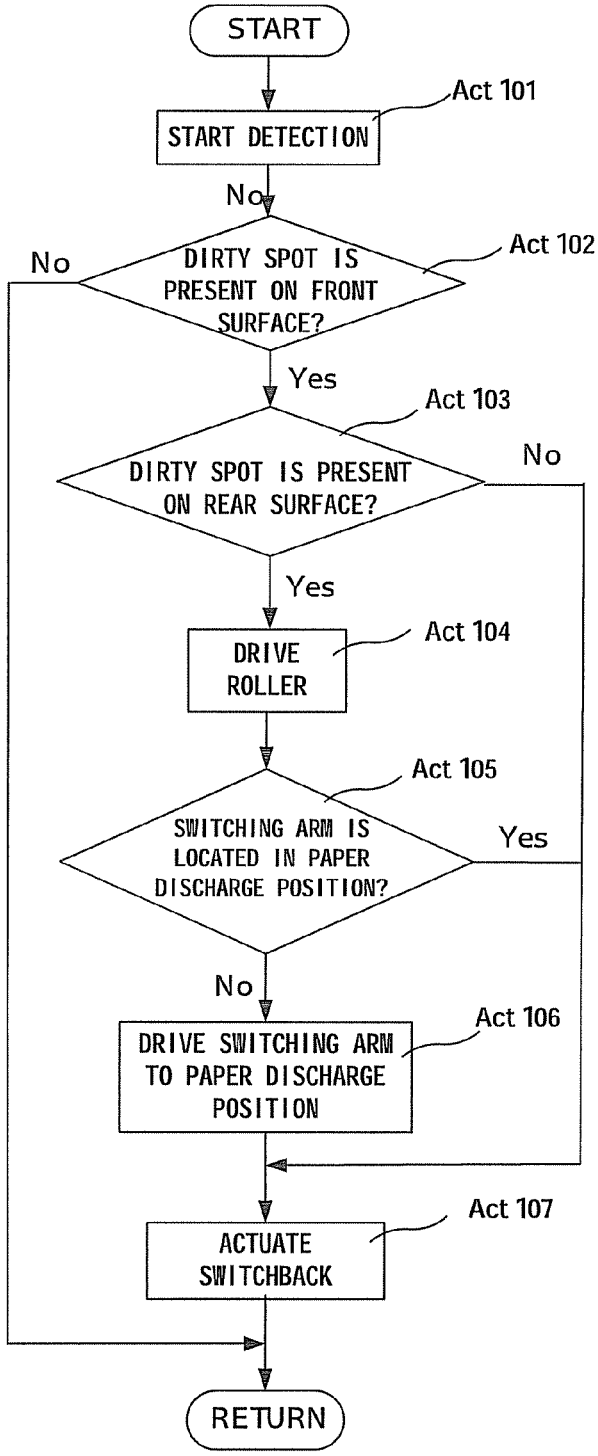
FIG. 5 is a flowchart for explaining dirty spot detection and the operation of the image forming apparatus after the dirty spot detection.

A stain-recognition-condition adjusting unit 803 changes a condition for stain recognition that should be performed by the CPU 801. Specifically, the stain-recognition-condition adjusting unit 803 displays a setting screen for setting the stain recognition condition on the touch panel display. The stain-recognition-condition adjusting unit 803 can change the stain recognition condition when a user operates the setting screen. FIG. 4 is a diagram of an example of an adjustment screen displayed on the touch panel display. As shown in the figure, an adjusting section 702 is displayed on an adjustment screen 701. The adjusting section 702 includes a range display section 702A and a range changing section 702B.

The user can perform range adjustment in the adjusting section 702 by checking a check space in the adjusting section 702. A character group including "up", "down", "right", and "down" is displayed in the range changing section 702B. Arrows operated to change a stain recognition range are displayed beside the character group. The user can adjust the stain recognition range stepwise by clicking the arrows. However, the user can also change the stain recognition range by directly inputting a numerical value in the range changing section 702B without operating the arrows. In the example shown in the figure, dirty spot detection is executed for a region excluding a region of 2.5 cm from the upper end of a sheet, a region of 2.5 cm from the lower end, a region of 2.0 cm from the right end, and a region of 2.0 cm from the left end. The sheet and the stain recognition range in the sheet are displayed in the range display section 702A. The user can check the stain recognition range by viewing the range display section 702A.

Figure 10:
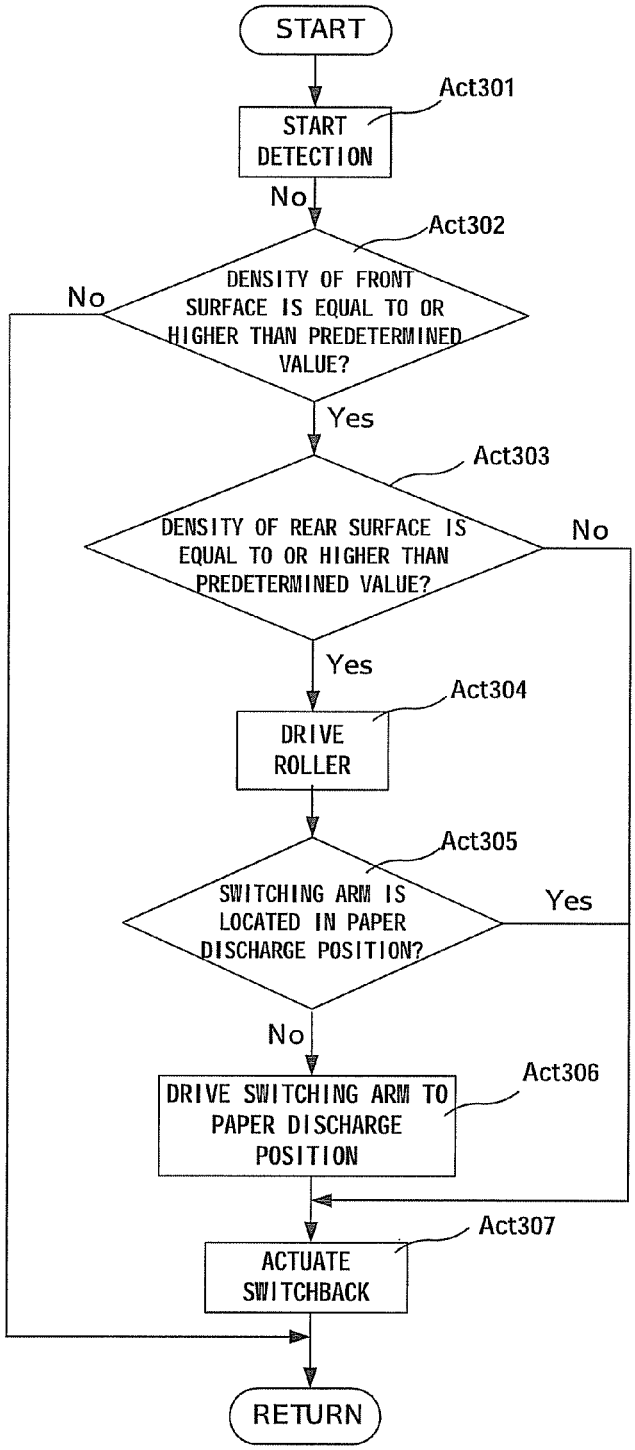
FIG. 10 is a flowchart for explaining density detection and the operation of the image forming apparatus after the density detection according to the third embodiment.

The operation of the image forming apparatus performed when a density of both sides of a sheet is detected is explained with reference to FIG. 10. FIG. 10 is a flowchart for explaining density detection and the operation of the image forming apparatus after the density detection. The CPU 801 executes the operation indicated by the flowchart. It is assumed that, in an initial state, the shaft sections U11 to U14 are located in the pressing position where the intermediate transfer belt 6 is pressed against the photoconductive member 2Y.

As shown in the figure, in Act 101, the CPU 801 starts the dirty spot detection by the detection sensors 804. In Act 102, the CPU 801 determines, on the basis of a result of the detection by the detection sensors 804, whether a dirty spot is present in a predetermined range set by the dirty-spot-detection adjusting section 702 on a front surface of a sheet that passes the dirty spot detection position D.

If the CPU 801 determines in Act 102 that no dirty spot is present in the predetermined range on the front surface of the sheet, the CPU 801 returns to Act 101 and starts the dirty spot detection for the next sheet. If the CPU 801 determines in Act 102 that a dirty spot is present in the predetermined range on the front surface of the sheet, the CPU 801 proceeds to Act 103.

In Act 103, the CPU 801 determines, on the basis of the result of the detection by the detection sensors 804, whether a dirty spot is present in the predetermined range set by the dirty-spot-detection adjusting section 702 on a rear surface of the sheet that passes the dirty spot detection position D. If the CPU 801 determines in Act 103 that a dirty spot is present on the rear surface of the sheet, the CPU 801 proceeds to Act 104. If the CPU 801 determines in Act 103 that no dirty spot is present on the rear surface of the sheet, the CPU 801 proceeds to Act 107.

As explained above, according to this embodiment, since the dirty spot detection is performed only for a predetermined region of a sheet, even if a dirty spot is present on the outside of the predetermined region, an image can be transferred onto the sheet. This makes it possible to effectively utilize the sheet.

In Act 104, the CPU 801 outputs a driving signal to a roller-shaft driving unit 805. The shaft sections U11 to U14 respectively move in a direction separating from the photoconductive members 2Y to 2K (a Z axis direction) on the basis of the driving signal. Consequently, the tension of the intermediate transfer belt 6 is reduced and the intermediate transfer belt 6 separates from the photoconductive members 2Y to 2K. As a result, it is possible to prevent an image from being transferred onto the dirty spot in the secondary transfer position T.

In Act 105, the CPU 801 determines whether the switching arm 16 is located in the paper discharge position. If the CPU 801 determines in Act 105 that the switching arm 16 is located in the paper discharge position, the CPU 801 proceeds to Act 106. If the CPU 801 determines in Act 105 that the switching arm 16 is not located in the paper discharge position, the CPU 801 proceeds to Act 107.

In Act 107, the CPU 801 actuates switchback and reverses the sheet conveying direction. Consequently, the sheet moves in an arrow direction shown in FIG. 2 and is guided by the switching arm 16 to thereby reach the paper discharge box 15. As a result, it is possible to thin out sheets onto which images cannot be transferred.

Second Embodiment

Figure 6:
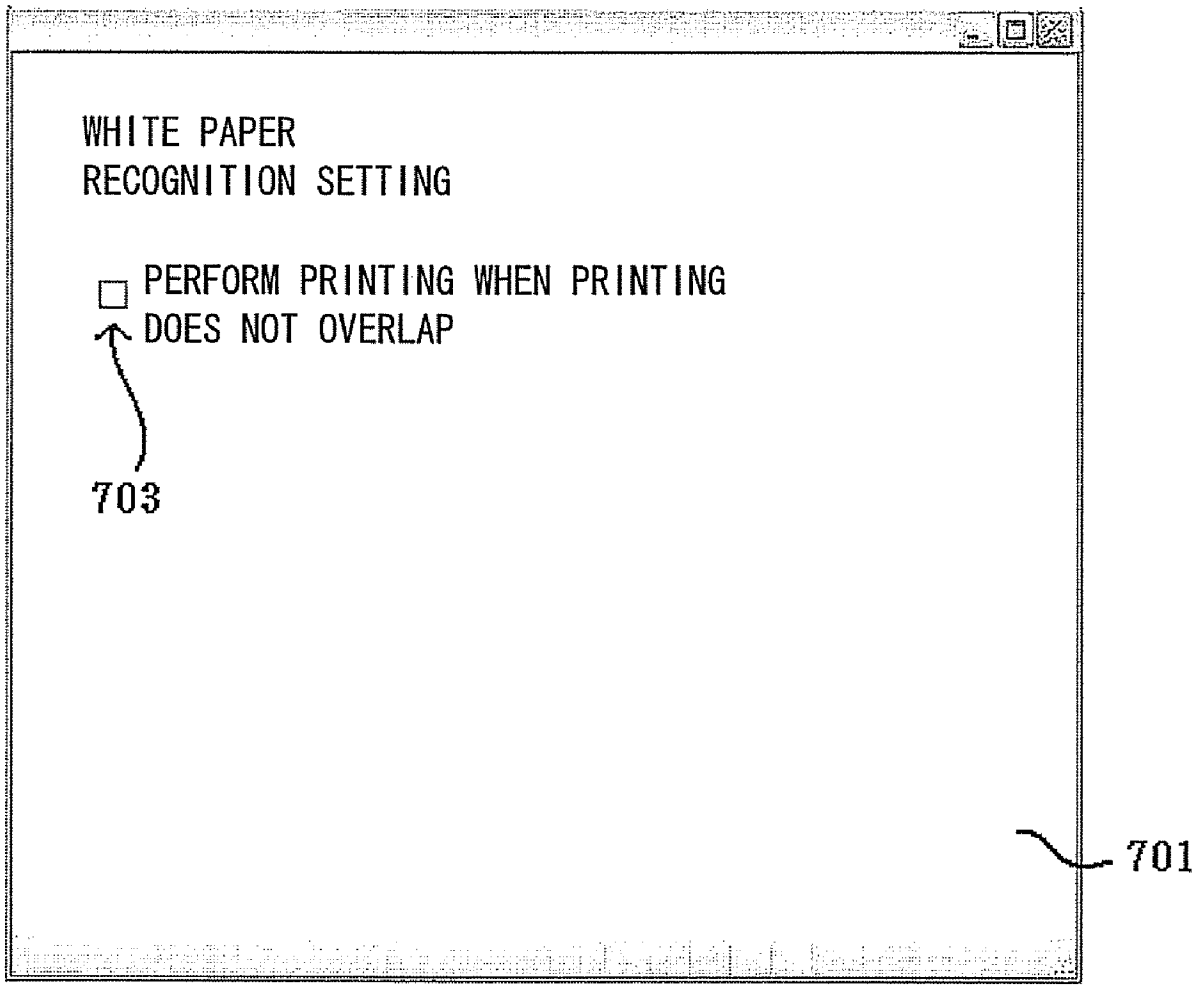
FIG. 6 is a schematic diagram of an adjustment screen displayed on a touch panel display according to a second embodiment of the present invention.

A second embodiment of the present invention is different from the first embodiment in a stain recognition condition that can be adjusted by the stain-recognition-condition adjusting unit 803. Since the other components are the same as those in the first embodiment, detailed explanation of the components is omitted. FIG. 6 is a diagram of an adjustment screen displayed on the touch panel display. As shown in the figure, an adjusting section 703 is displayed on the adjustment screen 701. A character string "perform printing when the printing does not overlap" are displayed in the adjusting section 703. A check space is displayed beside the characters. The user can executes the dirty spot detection according to this embodiment by checking the check space.

Figure 7:
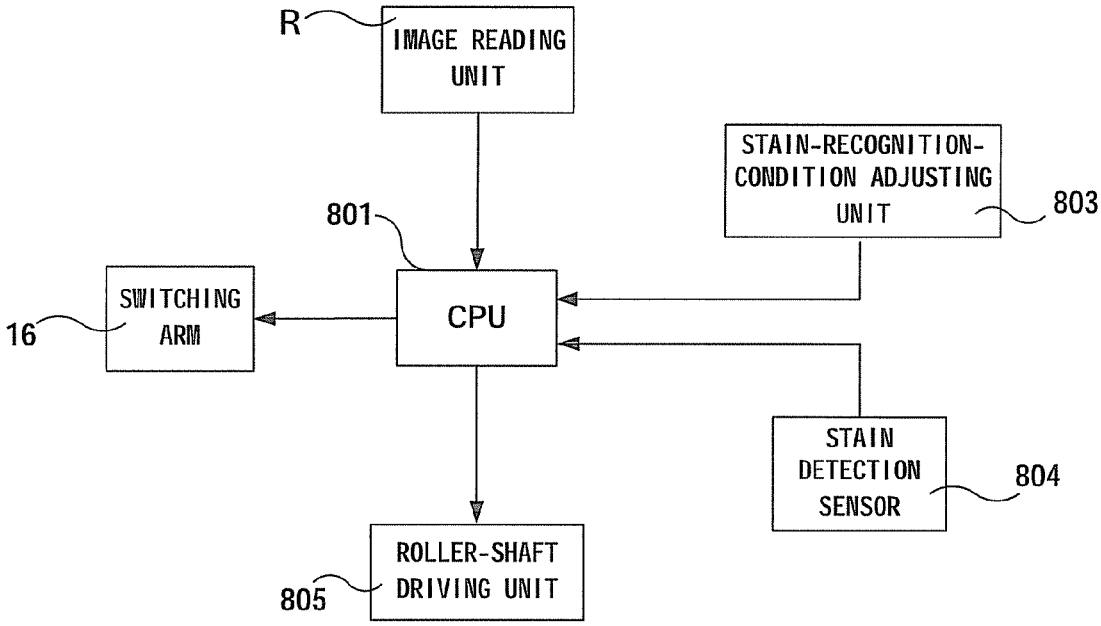
FIG. 7 is a functional block diagram of an image forming apparatus related to dirty spot detection for a sheet according to a second embodiment of the present invention.

FIG. 7 is a functional block diagram of an image forming apparatus related to the dirty spot detection for a sheet according to this embodiment.

Components having functions same as those in the first embodiment are denoted by the same reference numerals and signs. As shown in FIG. 7, the CPU 801 determines, on the basis of information concerning image data read by the image reading unit R and information concerning a dirty spot detected by the detection sensors (the dirty-spot-information acquiring units) 804, whether a dirty spot is present in a transfer planned region of a sheet onto which an image is transferred.

Figure 8:
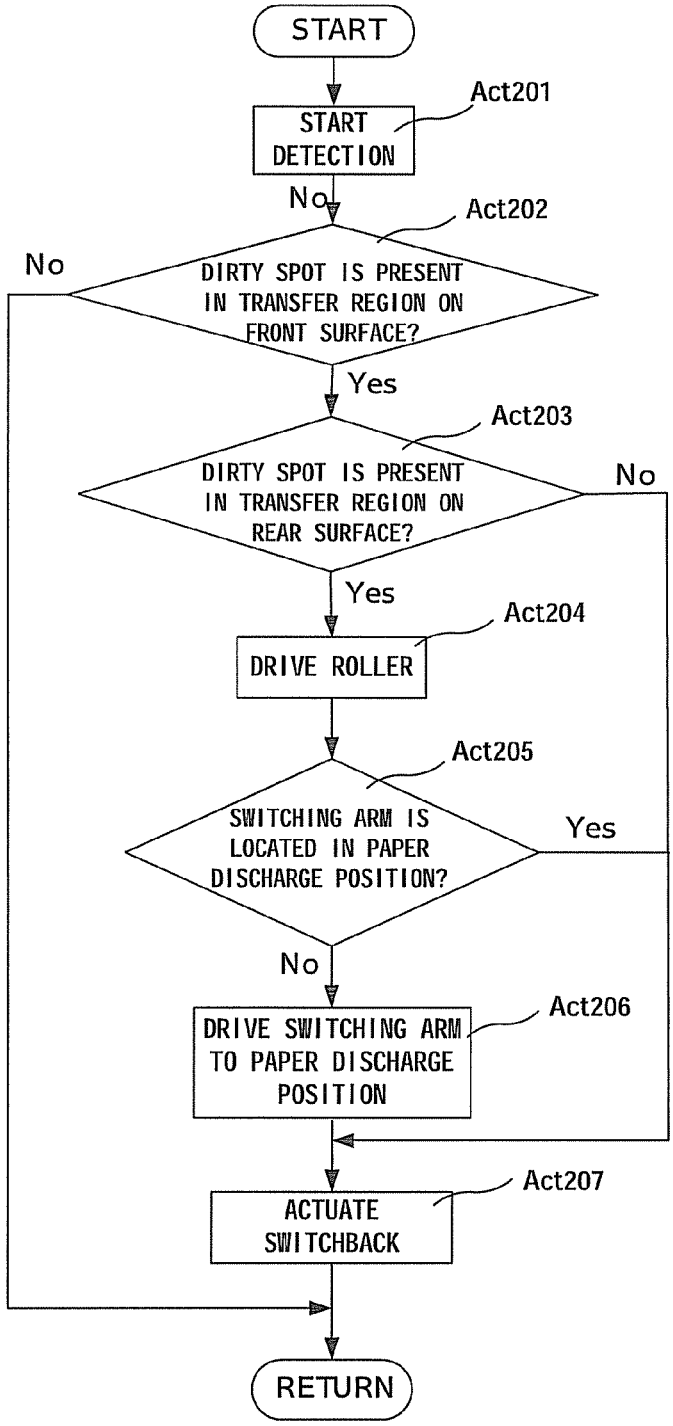
FIG. 8 is a flowchart for explaining dirty spot detection and the operation of the image forming apparatus after the dirty spot detection according to the second embodiment.

The operation of the image forming apparatus performed when a dirty spot on a sheet is detected is explained with reference to FIG. 8. FIG. 8 is a flowchart for explaining dirty spot detection and the operation of the image forming apparatus after the dirty spot detection. The CPU 801 executes the operation indicated by the flowchart. It is assumed that, in an initial state, the shaft sections U11 to U14 are located in the pressing position where the intermediate transfer belt 6 is pressed against the photoconductive member 2Y.

As shown in the figure, in Act 201, the CPU 801 starts dirty spot detection by the detection sensors 804. In Act 202, the CPU 801 determines, on the basis of information concerning image data read by the image reading unit R and information concerning dirty sots detected by the detection sensors 804, whether a dirty spot is present in a transfer region to which an image is transferred in a front surface of a sheet that passes the dirty spot detection position D.

If the CPU 801 determines in Act 202 that there is no dirty spot in the transfer region on the front surface of the sheet, the CPU 801 returns to Act 201 and starts the dirty spot detection for the next sheet. If the CPU 801 determines in Act 202 that a dirty spot is present in the predetermined transfer region on the front surface of the sheet, the CPU 801 proceeds to Act 203.

In Act 203, the CPU 801 determines, on the basis of a result of the detection by the detection sensors 804, whether a dirty spot is present in a transfer region to which an image is transferred in a rear surface of the sheet that passes the dirty spot detection position D. If the CPU 801 determines in Act 203 that a dirty spot is present in the transfer region on the rear surface of the sheet, the CPU 801 proceeds to Act 204. If the CPU 801 determines in Act 203 that there is no dirty spot on the rear surface of the sheet, the CPU 801 proceeds to Act 207.

In Act 204, the CPU 801 outputs a driving signal to the roller-shaft driving unit 805. The shaft sections U11 to U14 respectively move in the direction separating from the photoconductive members 2Y to 2K (the Z axis direction) on the basis of the driving signal. Consequently, the tension of the intermediate transfer belt 6 is reduced and the intermediate transfer belt 6 separates from the photoconductive members 2Y to 2K. As a result, it is possible to prevent an image from being transferred onto the sheet in the secondary transfer position T and reduce wasteful use of toners.

In Act 205, the CPU 801 determines whether the switching arm 16 is located in the paper discharge position. If the CPU 801 determines in Act 205 that the switching arm 16 is located in the paper discharge position, the CPU 801 proceeds to Act 206. If the CPU 801 determines in Act 205 that the switching arm 16 is not located in the paper discharge position, the CPU 801 proceeds to Act 207.

In Act 207, the CPU 801 actuates switchback and reverses the sheet conveying direction. Consequently, the sheet moves in the arrow direction shown in FIG. 2 and reaches the paper discharge box 15 while being guided by the switching arm 16. As a result, it is possible to thin out sheets onto which images are transferred to overlap dirty spots.

According to this embodiment, it is possible to surely prevent a transferred image and a dirty spot from being superimposed on a sheet.

Third Embodiment

Figure 9:
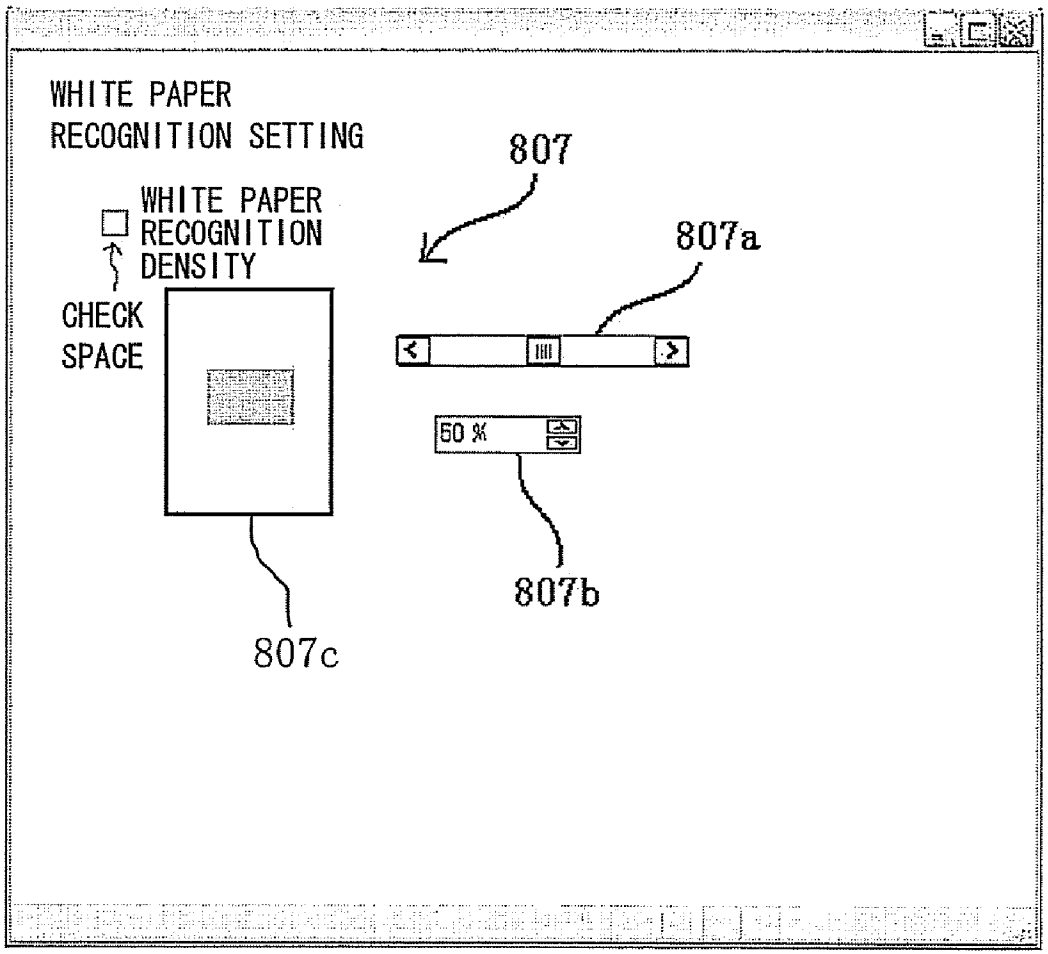
FIG. 9 is a schematic diagram of an adjustment screen displayed on a touch panel display according to a third embodiment of the present invention.

A third embodiment of the present invention is different from the first and second embodiments in a stain recognition condition that can be adjusted by the stain-recognition-condition adjusting unit 803. The other components are the same as those in the first embodiment. FIG. 9 is a diagram of an adjustment screen displayed on the touch panel display. A detection-density setting section 807 shown in the figure is operated to adjust detection density. The detection-density setting section 807 can be used when a check space displayed on the touch panel display is checked. A density changing section 807*a* is displayed on the touch panel display. When a user clicks an arrow on the right side of the density changing section 807*a*, the detection density rises. When a user clicks an arrow on the left side of the density changing section 807*a*, the detection density falls. A numerical value of the detection density is displayed in a first detection-density display section 807*b*. Therefore, the user can check the detection density by viewing the numerical value displayed in the first detection-density display section 807*b*. The user can change the detection density by clicking arrows of the first detection-density display section 807*b*.

A second detection-density display section 807*c* is displayed on the left side of the density changing section 807*a* and the first detection-density display section 807*b*. Shading corresponding to the detection density is displayed in the second detection-density display section 807*c*. In an example shown in the figure, rectangular shading displayed in the center of the second detection-density display section 807*c* changes when the user operates the density changing section 807*a*. The user can check density by viewing the shading.

The CPU 801 determines, on the basis of reflectance acquired via the detection sensors (the density-information acquiring units) 804, whether the density of a sheet exceeds the detection density set by the detection-density setting section 807. When the density of the sheet exceeds the detection density, the CPU 801 prohibits transfer onto the sheet. When the density of the sheet is equal to or lower than the detection density, the CPU 801 permits transfer onto the sheet.

The operation of the image forming apparatus performed when a dirty spot on a sheet is detected is explained with reference to FIG. 10. FIG. 10 is a flowchart for explaining dirty spot detection and the operation of the image forming apparatus after the dirty spot detection. The CPU 801 executes the operation indicated by the flowchart. It is assumed that, in an initial state, the shaft sections U11 to U14 are located in the pressing position where the intermediate transfer belt 6 is pressed against the photoconductive member 2Y.

As shown in the figure, in Act 301, the CPU 801 executes density detection by the detection sensors 804. In Act 302, the CPU 801 determines, on the basis of the density detection by the detection sensors 804, whether the density of a front surface of a sheet exceeds predetermined density set by the detection-density setting section 807.

When the CPU 801 determines in Act 302 that the density of the front surface of the sheet does not exceed the predetermined density, the CPU 801 returns to Act 301 and starts the density detection for the next sheet. When the CPU 801 determines in Act 302 that the density of the front surface of the sheet exceeds the predetermined density, the CPU 801 proceeds to Act 303.

In Act 303, the CPU 801 determines, on the basis of the density detection by the detection sensors 804, whether the density of a rear surface of the sheet exceeds the predetermined density set by the detection-density setting section 807. When the CPU 801 determines in Act 303 that the density of the rear surface of the sheet exceeds the predetermined density, the CPU 801 proceeds to Act 307.

In Act 304, the CPU 801 outputs a driving signal to the roller-shaft driving unit 805. The shaft sections U11 to U14 respectively move in the direction separating from the photoconductive members 2Y to 2K (the Z axis direction) on the basis of the driving signal. Consequently, the tension of the intermediate transfer belt 6 is reduced and the intermediate transfer belt 6 separates from the photoconductive members 2Y to 2K. As a result, it is possible to prevent an image from being transferred onto the sheet in the secondary transfer position T and reduce wasteful use of toners.

In Act 305, the CPU 801 determines whether the switching arm 16 is located in the paper discharge position. When the CPU 801 determines in Act 305 that the switching arm 16 is located in the paper discharge position, the CPU 801 proceeds to Act 306. When the CPU 801 determines in Act 305 that the switching arm 16 is not located in the paper discharge position, the CPU 801 proceeds to Act 307. In Act 306, the CPU 801 moves the switching arm 16 to the paper discharge position and proceeds to Act 307.

In Act 307, the CPU 801 actuates switchback and reverses the sheet conveying direction. Consequently, the sheet moves in the arrow direction shown in FIG. 2 and is guided by the switching arm 16 to thereby reach the paper discharge box 15. As a result, it is possible to thin out sheets having high density onto which images cannot be transferred.

According to this embodiment, it is possible to eliminate deficiencies that, for example, an image cannot be recognized because the image is transferred onto a sheet having high density.

MODIFICATIONS

In the first to third embodiments, in order to prevent transfer of an image onto a sheet on which a dirty spot is detected, the transfer belt 6 is separated from the photoconductive members 2Y to 2K. However, the present invention is not limited to this. Other methods can also be used. For example, a discharging and conveying path extending to a position different from the second transfer position T may be formed in the sheet conveying path extending from the dirty spot detection position D to the secondary transfer position T. A sheet having a dirty spot and a sheet having high density may be discharged via the discharging and conveying path. The primary transfer to the transfer belt 6 may be prevented by separating the photoconductive members 2Y to 2K from the transfer belt 6. Processing for prohibiting formation of electrostatic latent images on the photoconductive surfaces of the photoconductive members 2Y, 2M, 2C, and 2K immediately after dirty spot detection is performed can also be performed.

In the embodiments, a stained sheet that passes the secondary transfer position T is discarded in the paper discharge box 15. However, the present invention is not limited to this. Other methods can also be used. For example, all of sheets onto which developer images are not transferred (hereinafter referred to as dirty spot sheets) and sheets onto which the developer images are transferred (hereinafter referred to as transfer sheets) can also be discharged to the discharge tray 8. In this case, it is advisable to control a mechanism related to the discharge such that discharge positions on the discharge tray 8 of the dirty spot sheets and the transfer sheets are different from each other. For example, the discharge positions can be changed by changing speed of discharge such that speed of discharging the dirty spot sheets and speed of discharging the transfer sheets are different from each other or moving the discharge tray 8 back and forth in an X axis direction.

It is assumed that the paper feeding tray includes not only a cassette tray but also a so-called manual feed tray.

The present invention can be carried out in various other forms without departing from the spirit or the main characteristic thereof. Therefore, the embodiments are merely illustrations in all aspects and should not be limitedly interpreted. The scope of the present invention is indicated by patent claims and is not bound by the text of the specification at all. All alterations and various improvements, substitutions, and modifications belonging to the scope of equivalents of claims are within the scope of the present invention.

What is claimed is:

1. An image forming apparatus comprising:

a sheet conveying path configured to convey a sheet from a paper feeding tray to a transfer position;

an image transfer unit configured to transfer an image onto the sheet conveyed to the transfer position via the sheet conveying path;

a dirty-spot-information acquiring unit that has light emitting elements which irradiate a predetermined region of the sheet and light receiving elements which receive the reflected light of light irradiated on the predetermined region from the light emitting elements, the dirty-spot-information acquiring unit configured to acquire information concerning a dirty spot on the sheet by calculating a reflectance of the predetermined region based on input and output of both the light emitting elements and the light receiving elements in a detection position located further on an upstream side in a conveying direction than the transfer position in the sheet conveying path; and a determining unit configured to determine that at least one dirty spot is present in the predetermined region, if the area from which the information concerning the dirty spot is acquired by the dirty-spot-information acquiring unit has an area equal to or larger than a predetermined area.

2. The apparatus according to claim 1, further comprising a changing unit configured to change the predetermined region.

3. The apparatus according to claim 1, further comprising:

a discharge tray to which the sheet, on which the image is transferred in the transfer position, is discharged; and a discharge path for discharging the sheet to a position different from the discharge tray when the determining unit determines that a dirty spot is present in the predetermined region of the sheet.

4. An image forming apparatus comprising:

a sheet conveying path configured to convey a sheet between a paper feeding tray and a transfer position;

an image transfer unit configured to transfer an image onto the sheet conveyed to the transfer position via the sheet conveying path;

a density-information acquiring unit configured to optically acquire information concerning density of both sides of the sheet in a detection position located further on an upstream side in a conveying direction than the transfer position in the sheet conveying path; and a determining unit configured to determine, on the basis of the information acquired by the density-information acquiring unit, whether the density of both sides of the sheet exceeds a predetermined value.

5. The apparatus according to claim 4, wherein the determining unit performs the determination only for a predetermined region in the sheet.

6. The apparatus according to claim 5, further comprising a changing unit configured to change the predetermined region.

7. A sheet determining method in an image forming apparatus including a sheet conveying path configured to convey a sheet between a paper feeding tray and a transfer position, and an image transfer unit configured to transfer an image onto the sheet conveyed to the transfer position via the sheet conveying path, the sheet determining method comprising:

optically acquiring information concerning density of both sides of the sheet in a detection position located further on an upstream side in a conveying direction than the transfer position in the sheet conveying path; and determining, on the basis of the acquired information, whether the density of both sides of the sheet exceeds a predetermined value.

8. The method according to claim 7, wherein the determination is performed only for a predetermined region in the sheet.

9. The method according to claim 8, further comprising changing the predetermined region.

* * * * *